US005888101A

United States Patent [19]

Dent et al.

[11] Patent Number: 5,888,101

[45] Date of Patent: Mar. 30, 1999

[54] ELECTRICAL CONNECTORS

[75] Inventors: Peter Dent, London; Gavin Harry Mintern, Enfield; Brian Shepherd, Wendover; Amanda Jane Wilson, Dunstable, all of England

[73] Assignee: Smiths Industries Public Limited Company, London, England

[21] Appl. No.: 912,358

[22] Filed: Aug. 18, 1997

[30] Foreign Application Priority Data

Aug. 22, 1996 [GB] United Kingdom ..... 9617714

[51] Int. Cl.[6] ..... H01R 13/64

[52] U.S. Cl. ..... 439/680; 439/378

[58] Field of Search ..... 439/677, 680, 439/681, 374, 378

[56] References Cited

U.S. PATENT DOCUMENTS 5,252,089 10/1993 Hatagishi et al. .
5,370,556 12/1994 Olsson ..... 439/681
5,425,650 6/1995 Maeda .
5,441,426 8/1995 Boulais ..... 439/681
5,466,171 11/1995 Bixler et al. ..... 439/680 X
5,520,555 5/1996 Taylor .
5,613,881 3/1997 Ichida et al. ..... 439/680

FOREIGN PATENT DOCUMENTS 207842A 1/1987 European Pat. Off. .
676828A 10/1995 European Pat. Off. .

*Primary Examiner*—Khiem Nguyen
*Attorney, Agent, or Firm*—Pollock, Vande Sande & Amernick

[57] ABSTRACT

An electrical connector has two parts each with a rectangular shell surrounding contact elements. The outside of one shell and the inside of the other are enlarged in the corners and so that the two shells can only be mated when presented square-on, thereby reducing the risk that the contact elements on one part will be inadvertently contacted by the shell on the other part. The two parts have mating coding members and clamping members located outside the shells, one part having two tower formations in which the coding and clamping members are located. The width of the towers is greater than the width of the shell on the other part.

12 Claims, 2 Drawing Sheets

ELECTRICAL CONNECTORS

BACKGROUND OF THE INVENTION

This invention relates to electrical connectors.

One part of one type of electrical connector comprises a metal shell containing an insulative insert supporting an array of electrical pin elements. The other part of the connector comprises a metal shell projecting above and around an array of socket elements within which corresponding ones of the pin elements are inserted, the shell protecting the sockets from damage. When the two parts of the connector are mated, the shell of the second part extends around the shell of the first part and the pins of the first part extend within and make electrical contact with the sockets of the second part.

One problem with such connectors, especially if they are of rectangular shape, is that, if the connectors are not mated square, an edge of the shell of the first part can be inserted into the other shell in such a way as to contact the sockets. This may result in mechanical damage to the sockets and, by bridging or grounding the sockets, may also cause electrical damage in associated equipment if the parts of the connector are brought together while the sockets are live. There can also be a problem with rectangular electrical connectors if the two parts of the connector should be incorrectly oriented, that is, with one part rotated through 180° relative to the other. This could result in damage to the sockets or in the mating of incorrect pins in sockets. This is a particular problem where one part of the connector is freely mounted at the end of a cable and is to be inserted in the other part of the connector at an inaccessible location, so that it is difficult to ensure that the two parts of the connector are presented square on to each other.

BRIEF SUMMARY OF THE INVENTION

It is an object of the present invention to provide an improved electrical connector.

According to one aspect of the present invention there is provided a two-part electrical connector having a first part with a generally rectangular shell surrounding an array of contact elements and a second part with a second generally rectangular shell surrounding an array of mating contact elements, said second shell being insertable within said first shell, the external shape of the second shell and the internal shape of the first shell being such that the second shell cannot be brought into contact with the contact elements in the first shell when the longitudinal or lateral axes of the two shells lie in a common plane but the two shells are not presented square on.

The dimensions of the first and second shells parallel to their walls are preferably greater towards their corners than away from their corners such that the reduced dimensions of the first shell away from its corners restricts insertion of the edges of the second shell except when the first and second shells are presented square-on with one another.

According to another aspect of the present invention there is provided a two-part electrical connector having a first part with a generally rectangular shell surrounding an array of contact elements and a second part with a second generally rectangular shell surrounding an array of mating contact elements, said second shell being insertable within said first shell, the dimensions of the first and second shells parallel to their walls being greater towards their corners than away from their corners such that the reduced dimensions of the first shell away from its corners restricts insertion of the edges of the second shell except when the first and second shells arc presented square-on with one another.

The first shell is preferably provided with at least one ledge projecting inwardly along the inside of each wall of the shell to a level above that of the contact elements, the ledges terminating short of the corners of the shell. The ledges are preferably provided in a lower part of the shell. The internal shape of the first shell is preferably different along opposite walls so as to ensure that a second shell having a corresponding external shape can only be inserted in the correct orientation. The connector may have coding means on both parts, each coding means being located on a part of the connector external of the respective shell. The connector preferably has a cooperating clamping member on both parts, the clamping members being located on a part of the connector external of the respective shell. The external part of one part of the connector may be provided by a tower formation at opposite ends of the connector. The tower formation on one part of the connector is preferably wider that an internal dimension of the shell of the other part of the connector.

An electrical connector for an aircraft electronics system, according to the present invention, will now be described, by way of example, with reference to the accompanying drawings.

DETAILED DESCRIPTION OF THE PREFERRED EMBODIMENT

Figure 1:
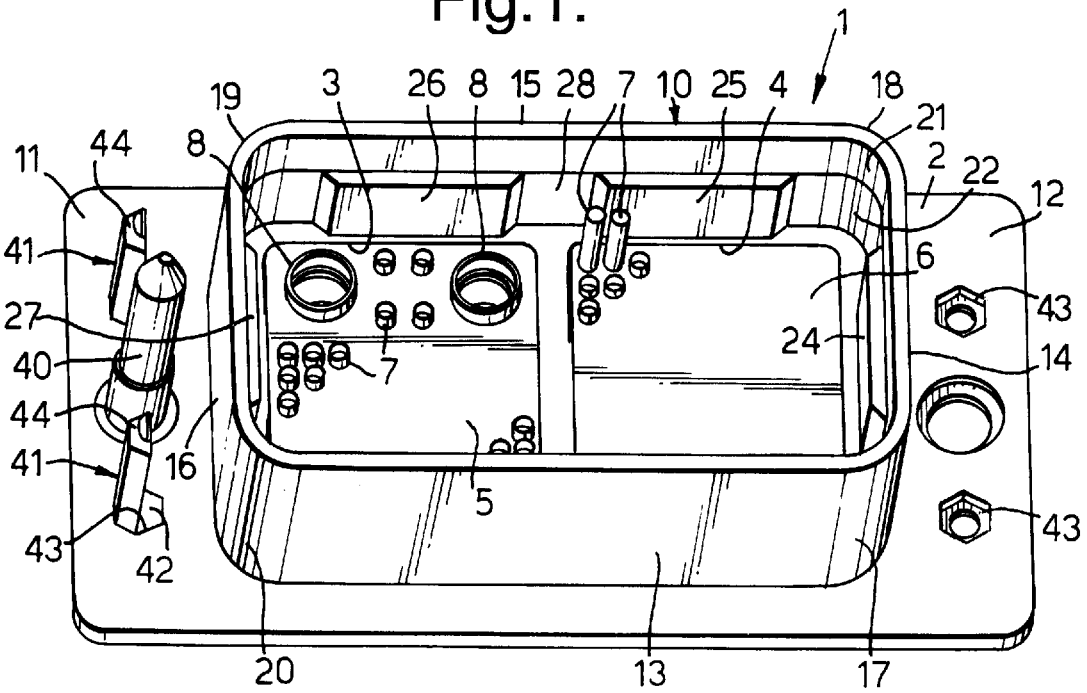
FIG. 1 is a perspective view of a first part of the connector.
Figure 2:
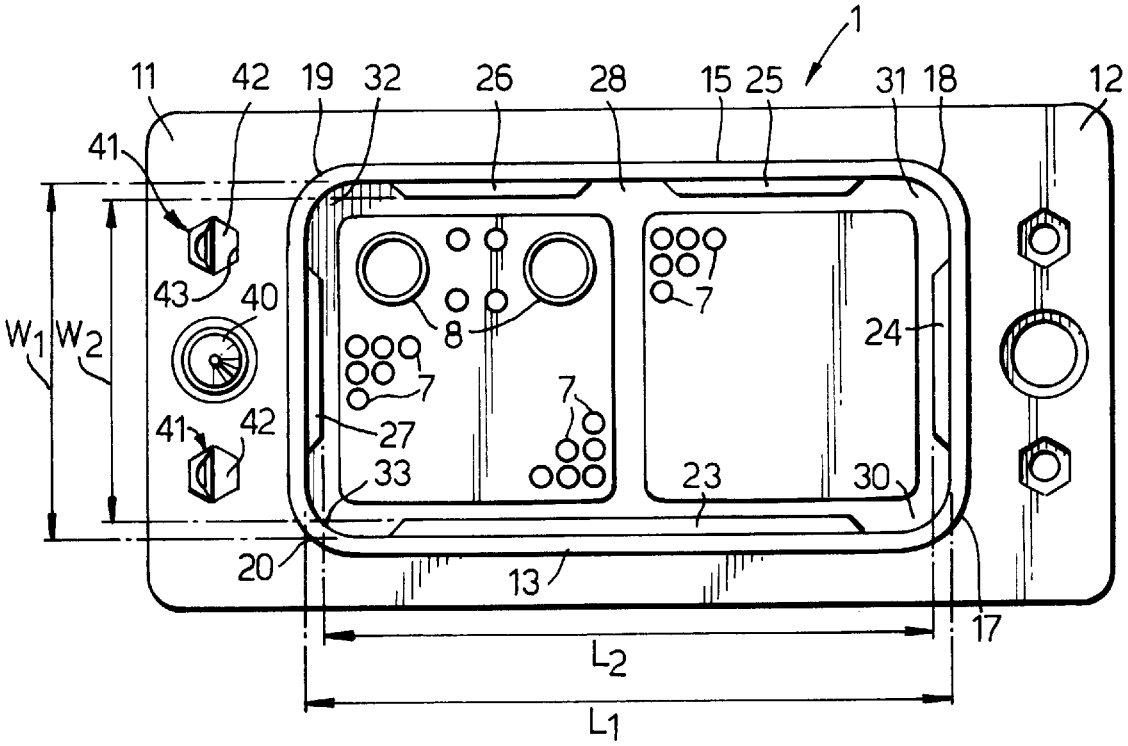
FIG. 2 is a plan view of the first part of the connector.

With reference first to FIGS. 1 and 2, the first part 1 of the connector has a rectangular metal plate 2, about 94 mm by 48 mm, with two apertures 3 and 4 approximately square in shape and about 27 mm wide. Both apertures 3 and 4 support an electrically-insulative insert 5 and 6, which in turn support arrays of electrical female, socket contact elements 7 and larger diameter coaxial, triaxial or fibre-optic contact elements 8 (only some of which are shown). The upper surface of the inserts 5 and 6 is raised above the upper surface of the plate 2 by about 5 mm, with the contacts 7 and 8 projecting above the surface of the inserts by about 11 mm.

The first part 1 of the connector also has a rectangular metal shell 10 integral with and projecting upwardly from the center of the plate 2. The shell 10 is about 66 mm long and 37 mm wide and surrounds the two inserts 5 and 6 and their contacts 7 and 8. The space between opposite ends of the shell 10 and the ends of the plate 2 form respective shoulders 11 and 12 at opposite ends of the plate. Externally, the shell 10 has four smooth flat walls 13 to 16 with rounded corners 17 to 20. Internally, the walls 13 to 16 are divided into an upper half 21 and lower half 22, the upper half being of the same shape as the external surface. The lower half 22 of the shell 10 is interrupted by five ledges 23 to 27 projecting inwardly of the shell, each being about 2 mm thick and with inclined ends. The height of each ledge slightly exceeds that of the contacts. One of the longer walls 13 has a single ledge 23, about 43 mm long, located centrally along the wall and terminating short of the corners 17 and 20. The opposite long wall 15 has two ledges 25 and 26 each about 17 mm long spaced from one another by a central gap 28, about 7 mm long and terminating short of the corners 18 and 19. The two shorter side walls 14 and 16 each have a single ledge 24 and 27, about 16 mm long, located centrally along the walls and terminating short of the corners 17 and 18, and 19 and 20. Thus at the four corners 17 to 20 of the shell 10, the ledges 23 to 27 are spaced from one another by gaps 30 to 33 so that the internal width $W_1$ and length $L_1$ at these gaps is greater than the width $W_2$ and length $L_2$ between opposite ledges 23 and 25 or 26, and 24 and 27.

The first part 1 of the connector also has two clamping members 40 (only one of which is shown) and four coding means 41 (only two of which are shown) mounted on the plate 2. The clamping members 40 each take the form of a threaded jackscrew located centrally across the width of the shoulders 11 and 12 at opposite ends of the plate 2 and projecting just above the upper edge of the shell 10. The coding means 41 are rods with a hexagonal base 42 received in a corresponding hexagonal aperture 43 in the shoulders 11 and 12. The rods 41 project vertically from the surface of the plate 2 to a height equal to that of the shell 10; that part of the rods projecting above the plate is cut in half longitudinally to form an upper part 44 of trapezium shape. By appropriately orienting the rods 41 in the apertures 43, the upper part 44 of each rod can be set in any one of six different orientations.

Figure 3:
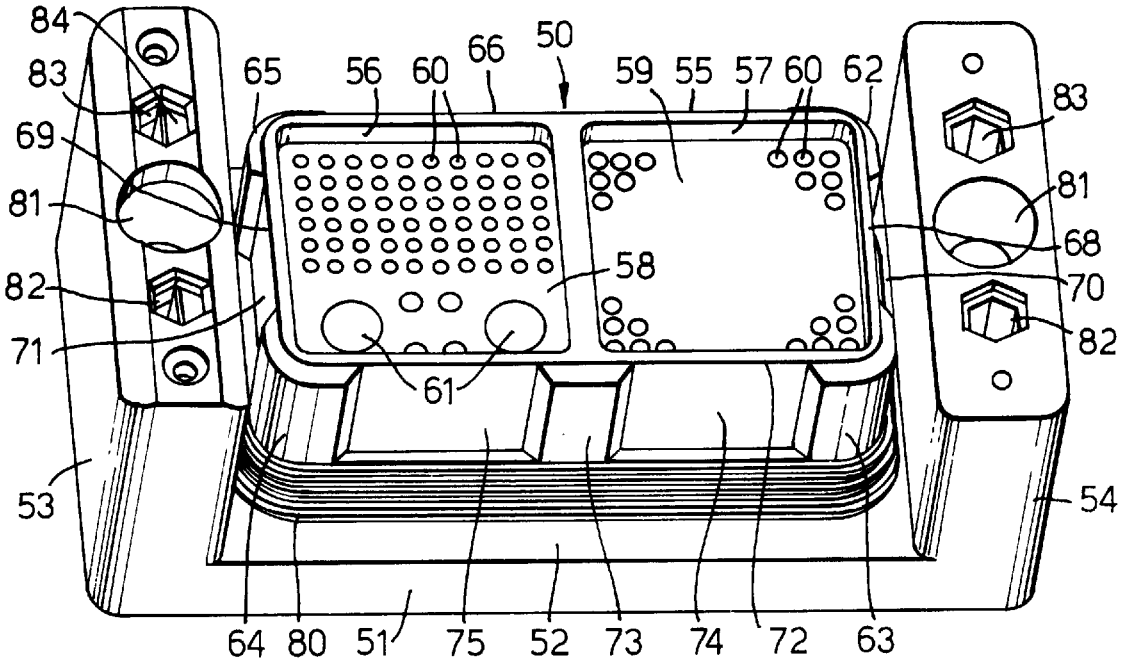
FIG. 3 is a perspective view of a second part of the connector.
Figure 4:
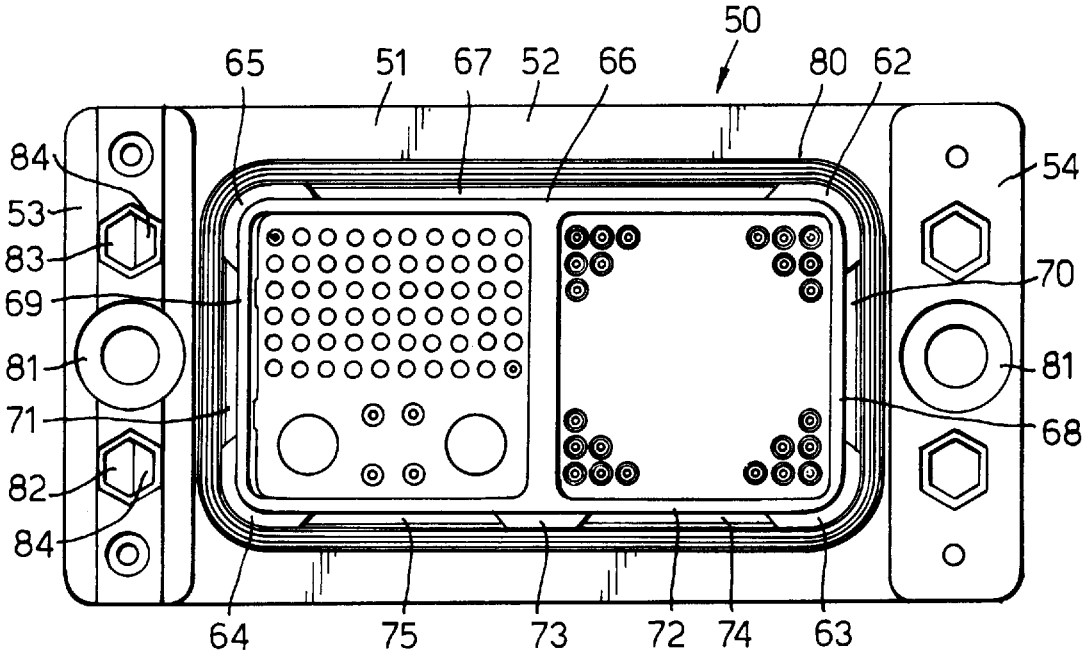
FIG. 4 is a plan view of the second part of the connector.

With reference now to FIGS. 3 and 4, the second part 50 of the connector has a metal base assembly 51 formed by a central flat plate 52 with two vertically-projecting tower formations 53 and 54 at each end and a central shell 55 between the towers. The shell 55 has two recesses 56 and 57 within it of substantially square shape in which are received electrically-insulative inserts 58 and 59, which in turn support arrays of electrical contact pins 60 and coaxial, triaxial or fibre-optic male contacts 61 in a corresponding pattern to that of the contact sockets 7 and 8 on the first part 1 of the connector. The pins 60 are protected by being located within bores in the inserts 58 and 59. The external surface of the shell 55 is shaped to be received within the shell 10 of the first part 1 of the connector. In particular, the shell 55 has four enlarged corners 62 to 65 shaped to slide into the gaps 30 to 33 at the corners of the shell 10 of the first part 1 of the connector. The corners 62 and 65 at opposite ends of one long wall 66 arc spaced from one another by a gap 67 in which can be received the single ledge 23 on the long wall 13 of the first part 1 of the connector. Similarly, the corners 62 and 63, and 64 and 65 at opposite ends of the shorter side walls 68 and 69 are separated by gaps 70 and 71 in which the ledges 24 and 27 can be received. The remaining long wall 72 of the shell 55 has a single central projection 73 spaced by gaps 74 and 75 from the corners 63 and 64; the two ledges 26 and 25 on the long wall 15 of the shell 10 can be received in these gaps.

An O-ring seal 80 of an elastomeric material extends around the lower part of the outside of the shell 55, to form a seal by engagement with the upper edge of the shell 10 of the first part 1 of the connector.

The two towers 53 and 54 extend across the entire width of the second part 50 and project a short distance above the upper edge of its shell 55, being spaced from the ends of the shell by a short distance sufficient to receive the shell 10 of the first part. Each tower 53 and 54 has a central, vertical bore 81 containing a threaded insert (not shown) into which respective ones of the clamping jackscrews 40 can be screwed. On either side of the clamping bore 81 of each tower 53 and 54, there is a hexagonal recess 82 and 83 containing a coding insert 84. The coding inserts 84 are of trapezium section, occupying half the cross-section of the recess 82 and 83; they can be inserted in any desired orientation to give the recess any one of six different codings.

The second part 50 of the connector is fixed to an electronics unit (not shown), which is, in turn, attached to the airframe. The first part 1 is connected at one end of a cable (not shown). The two parts 1 and 50 of the connector are mated together by aligning the two towers 53 and 54 on the second part 50 with the shoulders 11 and 12 on the first part 1 so that the two jackscrews 40 enter the respective bores 81 and the four coding rods 41 enter the respective coding recesses 82 and 83. In this position, the two shells 10 and 55 are presented square-on to each other with their longitudinal and lateral axes parallel. The coding rods and recesses give the connector a possible 1296 (that is, $6^4$) different codings. If the coding rods 41 and coding recesses 82 and 83 match one another, the two parts 1 and 50 can be drawn into full mating engagement by rotation of the two jackscrews 40. As the two parts 1 and 50 are brought closer together, the pins 60 and 61 engage respective sockets 7 and 8 to establish electrical and optical connection between them. When the two parts are fully mated, the upper edge of the shell 10 on the first part 1 engages with the O-ring seal 80 so as to protect the contacts from contamination.

The internal shape of the shell 10 on the first part 1 and the external shape of the shell 55 on the second part 50 ensure that the two parts of the connector cannot be mated when one is rotated by 180° relative to the other, even if the coding rods 41 and coding recesses 82 and 83 were to permit such mating.

Also, the shape of the two shells 10 and 55 reduces the risk of an edge of the second shell inadvertently contacting the sockets 7 and 8 in the first shell during mating. In an inaccessible location it might be difficult to present the two parts of the connector square on to each other. An attempt might be made to insert the second part 50 edge-on into the other part 1, for example, with the edge of the short wall 69 being inserted into the shell 10 first, so that the longitudinal axes of the two parts are inclined relative to one another. If this were done, the upper half 21 of the walls 13 and 15 of the shell 10 would act to align the longitudinal axes of the two parts in a common plane. The angle between the two axes, however, would prevent the enlarged corners 64 and 65 of the second shell 55 aligning with the gaps 32 and 33 so that the enlarged corners come into contact with the top of the ledges 23 and 25, thereby preventing the wall 69 being inserted far enough to contact the sockets 7 and 8. Similarly, if the long wall 66 were inserted first, the upper half 21 of the walls 14 and 16 would act to align the lateral axes of the first and second parts and the enlarged corners 62 and 65 would contact the ledges 27 and 24. This effectively makes the connector scoop-proof when the longitudinal or lateral axes of the two parts lie on a common plane. It would be possible to contact the sockets 7 and 8 if the two parts of the connector were rotated 90° out of alignment with one another but this is unlikely to occur in practice. The width of the two towers 53 and 54 is also chosen so that it is wider than the internal width of the first shell 10. This reduces the risk of either tower 53 or 54 inadvertently being inserted into the first shell 10 and contacting the sockets 7 and 8.

The first shell need not have ledges of the kind shown if the two shells are otherwise arranged so that the dimensions of the first and second shells parallel to their walls are greater towards their corners than away from their corners.

What we claim is:

1. A two-part electrical connector comprising: a first part having a first generally rectangular shell surrounding an array of contact elements; and a second part having a second generally rectangular shell surrounding an array of mating contact elements, said second shell being insertable within said first shell, said second shell having two projections towards opposite ends of one side of said shell and at least one projection on a side of said second shell opposite to said one side, the internal shape of said first shell being such that said second shell cannot be brought into contact with said contact elements in said first shell when longitudinal or lateral axes of the said two shells lie in a common plane but said two shells are not presented square on.

2. An electrical connector according to claim 1, wherein said first and second shells have dimensions parallel to sides of said shells that are greater towards corners of said shells than away from said corners such that reduced dimensions of said first shell away from its corners restricts insertion of edges of said second shell within said first shell except when said first and second shells are presented square-one with one another.

3. A two-part electrical connector comprising: a first part having a generally rectangular first shell surrounding an array of contact elements; and a second part having a second generally rectangular shell surrounding an array of mating contact elements, said second shell being insertable within said first shell, said first and second shells having dimensions parallel to all four sides of said rectangular shells that are greater towards all four corners of said shells than away from said corners such that reduced dimensions of said first shell away from its corners restrict insertion of edges of said second shell within said first shell except when said first and second shells are presented square-on with one another.

4. An electrical connector according to claim 1 or 3, wherein said first shell is provided with at least one ledge projecting inwardly along the inside of each side of said shell to a level above that of the contact elements in said first part, and wherein said ledges terminate short of corners of said first shell.

5. An electrical connector according to claim 4, wherein said ledges are provided in a lower part of side walls of said shell.

6. An electrical connector according to claim 1 or 3, wherein said first shell has an internal shape that is different along opposite walls of said first shell so as to ensure that a second shell having a corresponding external shape can only be inserted in the correct orientation.

7. An electrical connector according to claim 1 or 3, wherein said connector has a coding member on each of said parts, and wherein each said coding member is located on a part of said connector external of the respective shell.

8. An electrical connector according to claim 1 or 3, wherein said connector has a cooperating clamping member on of said parts, and wherein said clamping members are located on a part of said connector external of the respective shell.

9. An electrical connector according to claim 7, wherein said external part of one part of the connector is provided by a tower formation at opposite ends of said one part.

10. An electrical connector according to claim 9, wherein said tower formation on said one part of said connector is wider than an internal dimension of said shell of the other part of said connector.

11. A two-part electrical connector comprising: a first part having a first generally rectangular shell surrounding an array of contact elements; and a second part having a second generally rectangular shell surrounding an array of mating contact elements, said second shell of said second part being insertable within said first shell, all four corners of said second generally rectangular shell being externally enlarged, the first shell of said first part having internally enlarged corners shaped to receive said externally enlarged corners of said second shell such as to restrict insertion of edges of said second shell into said first shell except when said first and second shells are presented square-on with one another.

12. An electrical connector according to claim 1, wherein said opposite side of said second shell has a projection located between opposite ends of said opposite side.

* * * * *